US006579024B2

(12) United States Patent
Trowbridge

(10) Patent No.: US 6,579,024 B2
(45) Date of Patent: Jun. 17, 2003

(54) APPARATUS TO CONNECT AN IMPLEMENT TO THE ARM OF A VEHICLE

(75) Inventor: Greg Douglas Trowbridge, New Plymouth (NZ)

(73) Assignee: JB Sales International Limited, Auckland (NZ)

( * ) Notice: Subject to any disclaimer, the term of this patent is extended or adjusted under 35 U.S.C. 154(b) by 0 days.

(21) Appl. No.: 09/769,772

(22) Filed: Jan. 26, 2001

(65) Prior Publication Data

US 2001/0026729 A1 Oct. 4, 2001

(30) Foreign Application Priority Data

Jan. 26, 2000 (NZ) ..... 502511

(51) Int. Cl.[7] ..... F16D 3/80

(52) U.S. Cl. ..... 403/34; 403/322.3; 403/322.4; 172/272; 37/468

(58) Field of Search ..... 403/321, 322.1, 403/322.4, 322.3, 324, 34, 35, 38; 172/272, 817, 245, 247; 414/705, 723; 37/468

(56) References Cited

U.S. PATENT DOCUMENTS 3,231,116 A * 1/1966 Powell ..... 414/694
4,042,131 A * 8/1977 Buttke ..... 214/138
4,397,604 A * 8/1983 McCain ..... 414/723
5,082,389 A 1/1992 Balemi ..... 403/322
5,193,915 A * 3/1993 Leidenfrost ..... 384/118
5,487,230 A * 1/1996 Weyer ..... 37/468
5,515,655 A * 5/1996 Hoffmann ..... 52/126.6
6,146,082 A * 11/2000 York ..... 414/723

FOREIGN PATENT DOCUMENTS

JP 62-37516 * 2/1987 ..... F16C/32/06
JP 62037516 * 2/1987 ..... 403/34
JP 4029606 * 1/1993 ..... 403/34

* cited by examiner

*Primary Examiner*—Lynne H. Browne
*Assistant Examiner*—Michael P. Ferguson
(74) *Attorney, Agent, or Firm*—Jacobson Holman PLLC

(57) ABSTRACT

An apparatus to connect an implement to a first apparatus, the apparatus including a first part adapted for attachment to the first apparatus, a second part adapted for attachment to a second apparatus. The first and second parts are articulated one with the other about an articulation axis. The parts are actuable between modes whereby, in one mode, the first and second parts can articulate relative to each other, and, in the second mode, the first and second parts cannot articulate relative to each other.

22 Claims, 7 Drawing Sheets

APPARATUS TO CONNECT AN IMPLEMENT TO THE ARM OF A VEHICLE

FIELD OF THE INVENTION

The present invention relates to apparatus to connect an implement or other apparatus (hereinafter "implement") to an arm, gib, boom or the like (hereinafter "arm") of a vehicle or other apparatus (for example a digger vehicle), methods arising from the use of such apparatus and to relate means and methods.

BACKGROUND OF THE INVENTION

In U.S. Pat. No. 5,082,389 we disclose many forms of connector adapted to allow the quick engagement of an implement to the distal end region of the arm of a digger or the like. The full content of U.S. Pat. No. 5,082,389 is hereby included by way of reference.

The apparatus of U.S. Pat. No. 5,082,389 includes means adapted for attachment to an arm and means adapted for attachment to the implement with no prospect of articulation between such means. The quick engagement arrangement is to the implement itself rather than to the arm with one of the two connection pins of a complementary implement being adapted to be received in one direction into a receiving opening with the other being received in from a slightly different direction and thereafter locked.

The arrangement of U.S. Pat. No. 5,082,389 relies upon hydraulics to hold the implement connected against the affect of a biasing spring. As disclosed in U.S. Pat. No. 5,082,389 the biasing spring tends to release the implement. Of course where it might otherwise be required the bias could be such that it holds the implement engaged such that in the event of a hydraulic failure there is no accidental release of the implement. In such an arrangement the hydraulic ram or rams should operate in the opposite direction to that disclosed in U.S. Pat. No. 5,082,389 or be double acting.

We recognise an advantage in being able to optimise the disposition of an implement (eg. bucket) to the arm axis. Whilst the arm may be of a number of members that move relative to each other a connector of the kind disclosed in to this U.S. Pat. No. 5,082,389 makes no provision for an angular disposition of an implement relative to the arm away from that at which it is up lifted.

SUMMARY OF THE INVENTION

It is therefore an object of the present invention to provide apparatus, methods and uses which depart from that admitted in respect of U.S. Pat. No. 5,082,389 to the extent that it will allow a degree of freedom between the interconnection to the arm and to the implement whereby, Preferably selectively an operator can choose a particular orientation that might be more favorable for the task at hand.

Accordingly in the first aspect, the present invention consists in apparatus to connect an implement to a first apparatus (eg. the arm of a vehicle), said apparatus comprising or including a first part adapted for attachment to said first apparatus, a second part adapted for attachment to a second apparatus (eg. an implement), wherein said first and second parts are articulated one with the other about an axis, and wherein means are provided actuable between modes whereby, in one mode, the first and second parts can articulate relative to each other, and, in the second mode, the first and second parts cannot articulate relative to each other.

Preferably said means relies upon the activation or deactivation of the pressurising of a fluid which can affect, by "movement" of a component, the frictional resistance to rotation about said axis.

Preferably said "movement" is a deformational movement or a relaxation from a previous deformational movement.

Preferably said first part includes means to receive a pin or pins for attachment to said first apparatus in an axis normal to the articulation axis.

Preferably said second apparatus is adapted to receive bars, rods, pins or the like of or for an implement which run in an axis normal to said articulation axis.

Preferably the adaption for attachment to an implement is of an arrangement typified by that of U.S. Pat. No. 5,082,389 or any variant thereof whether discussed above or hereinafter or not.

Preferably said articulation axis is one that will be in the preferred lowering/raising plane of the arm.

Preferably said articulation axis allows movement at least through a rotation arc of said second part relative to said first part but can be prevented from such movement upon a positive actuation at the control of an operator of said means.

Preferably said positive actuation is a causing of a frictional inter-engagement Preferably said frictional Inter-engagement is under the action of a pressurised fluid.

Preferably said pressurised fluid is a viscous liquid.

Preferably said pressurised fluid acts through a fluid inlet/outlet.

Preferably said fluid inlet/outlet is operated by the control of an operator of said means.

Preferably said fluid inlet/outlet operates at 55 mpa

Preferably said articulation axis is provided by a shaft and bearing arrangement.

Preferably said shaft is engaged to said second part (or vice versa) and said bearing is engaged to said first part.

Preferably said bearing comprises or includes two bearing regions having interposed therebetween a bearing region controllable to allow or not allow the shaft to rotate relative thereto.

Preferably one or other of said first or second parts is provided with said bearing and the other is provided with said shaft, such bearings and shafts preferably being intergral with or fixed to the appropriate part so as to not move relative thereto, save to the extent required to allow said bearing to cause the control required to allow or not to allow the shaft to rotate relative to the bearing.

Preferably the bearing includes a fluid jacket about a deformable region which in said second mode prevents rotation of the shaft relative thereto and which in said first condition will allow such rotation.

Preferably said shaft has a recess at the inside end of said bearing regions.

Preferably said recess contains an O ring.

Preferably said O ring prevents axial movement of lubrication grease into said deformable region.

In a further aspect the present invention consists in, as an assembly, apparatus of the kind previously defined when engaged to an arm of a vehicle or to an implement, or both.

Preferably said apparatus is adapted whereby upon a simple actuation by an operator the first and second part can be locked in a particular disposition about said articulation axis.

In a yet another aspect the present invention consists in apparatus of a kind adapted to be interposed between an implement (or first apparatus) and second apparatus (eg. the distal end of a hydraulically actuable arm of a vehicle (such as a digger)) characterised in that said apparatus includes a controllable articulation axis which both allows and disallows articulation of the first apparatus or implement, once engaged, relative to the second apparatus or the arm, such control allowing a selective fixing of the first apparatus or implement at a particular disposition relative to the second apparatus or the arm, (the articulation axis preferably being in the notional plane that includes a or the raising and lowering locus (should there be one) of the second apparatus or the arm).

In still a further aspect the present invention consists in the use of apparatus as aforesaid.

In still a further aspect the present invention consists in methods substantially as herein described with reference to the accompanying drawings.

In still a further aspect the present invention consists in apparatus and uses substantially as herein described with reference to the accompanying drawings.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

One preferred form of the present invention will now be described with reference to the accompanying drawings in which.

A preferred form of the present invention will now be described with reference to the accompanying drawings in which.

DETAILED DESCRIPTION OF THE PREFERRED EMBODIMENTS

Figure 1:
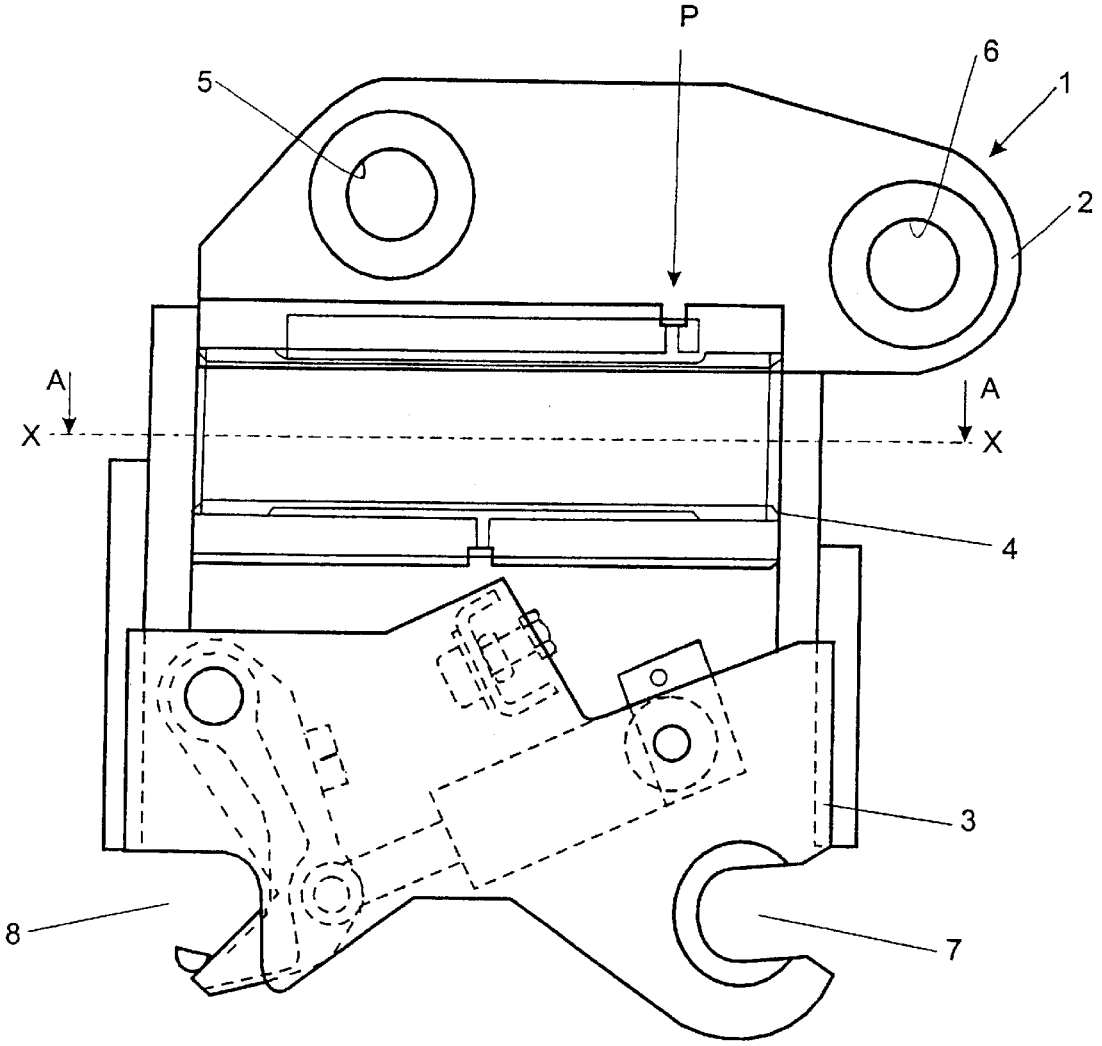
FIG. 1 is a cross sectional view of the preferred form of the device 1 showing the phantom features of the internal workings of the device.

In FIG. 1 there is shown the most preferred form of the present invention. FIG. 1 illustrates the device 1 which includes the first part 2 and the second part 3. The second part 3 incorporates a means for attachment of an implement to said device. The means to achieve such attachment is typified by that described in U.S. Pat. No. 5,082,389 which by way of reference is hereby, in its entirety, incorporated into the description of the present invention.

Alternative configurations of means to attach implements can be utilised and incorporated in the second part 3 of the present invention.

Said device 1 is adapted to provide a means of attachment for implements such as excavators, excavator buckets or the like to, for example a vehicle commonly used for digging. Attachment of the apparatus of the present invention to the arm of a vehicle is preferably achieved at the first part 2. In the most preferred form the first part 2 provides securing regions which are preferably apertures 5, 6 through which for example pins or bolts or other suitable fastening means can extend and allow connection of the apparatus to the digger arm. The apertures 5, 6 are preferably spaced apart at a suitable distance to ensure a strong and rigid connection to the digger arm. In the most preferred from the fluid inlet/outlet is P.

Figure 4:
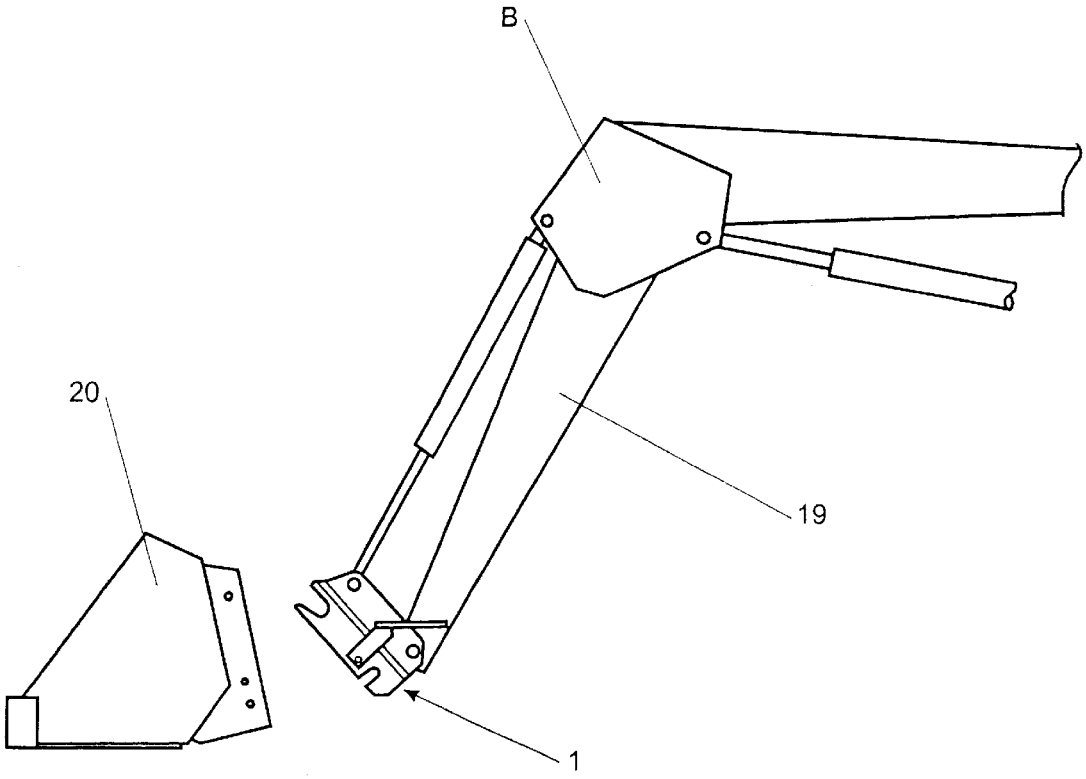
FIG. 4 is a side view of a vehicle of a kind which may receive the apparatus of the present invention.
Figure 5:
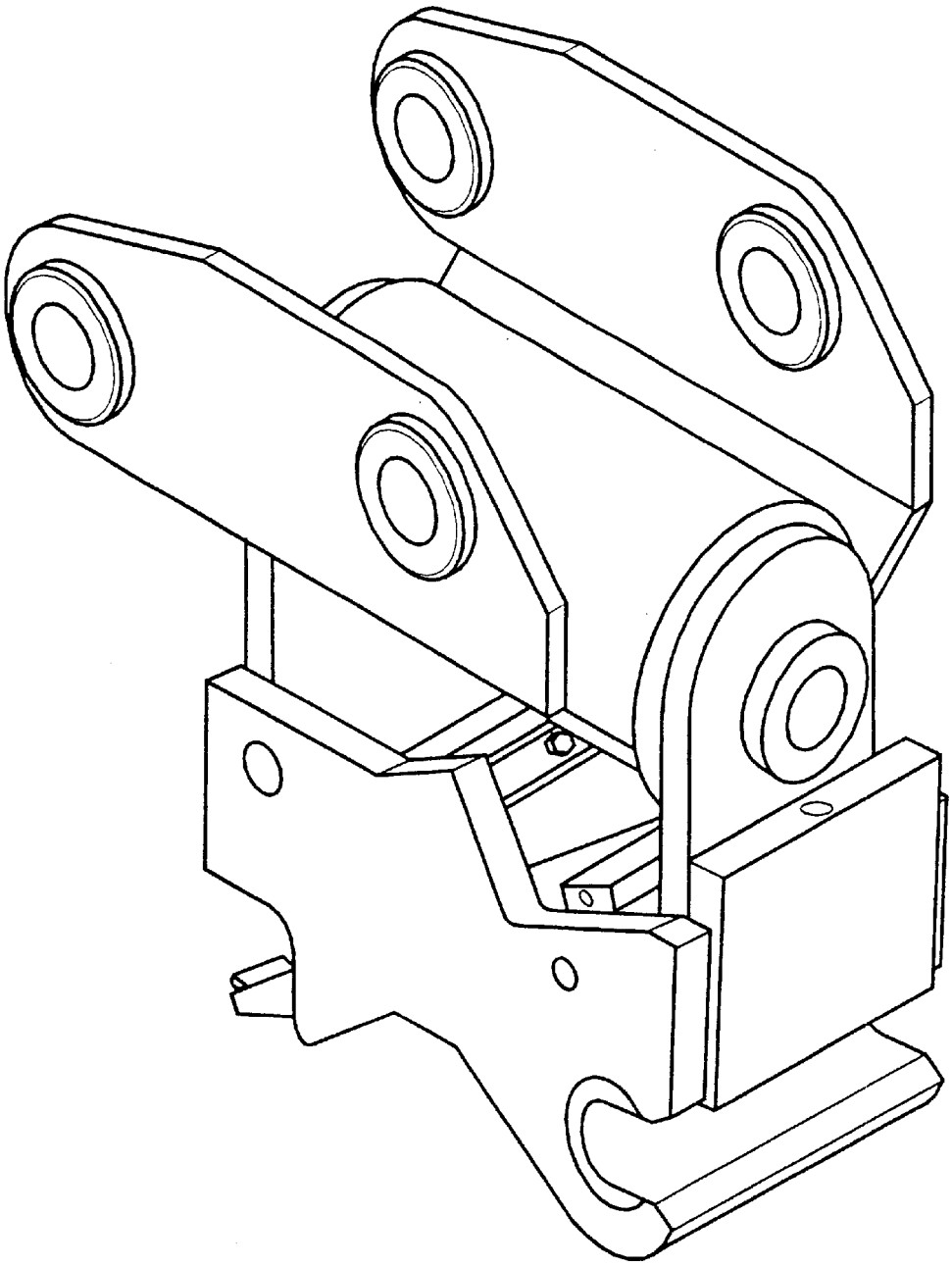
FIG. 5 is a perspective view of the device from the first side sightly off to the right of the rotational axis.
Figure 6:
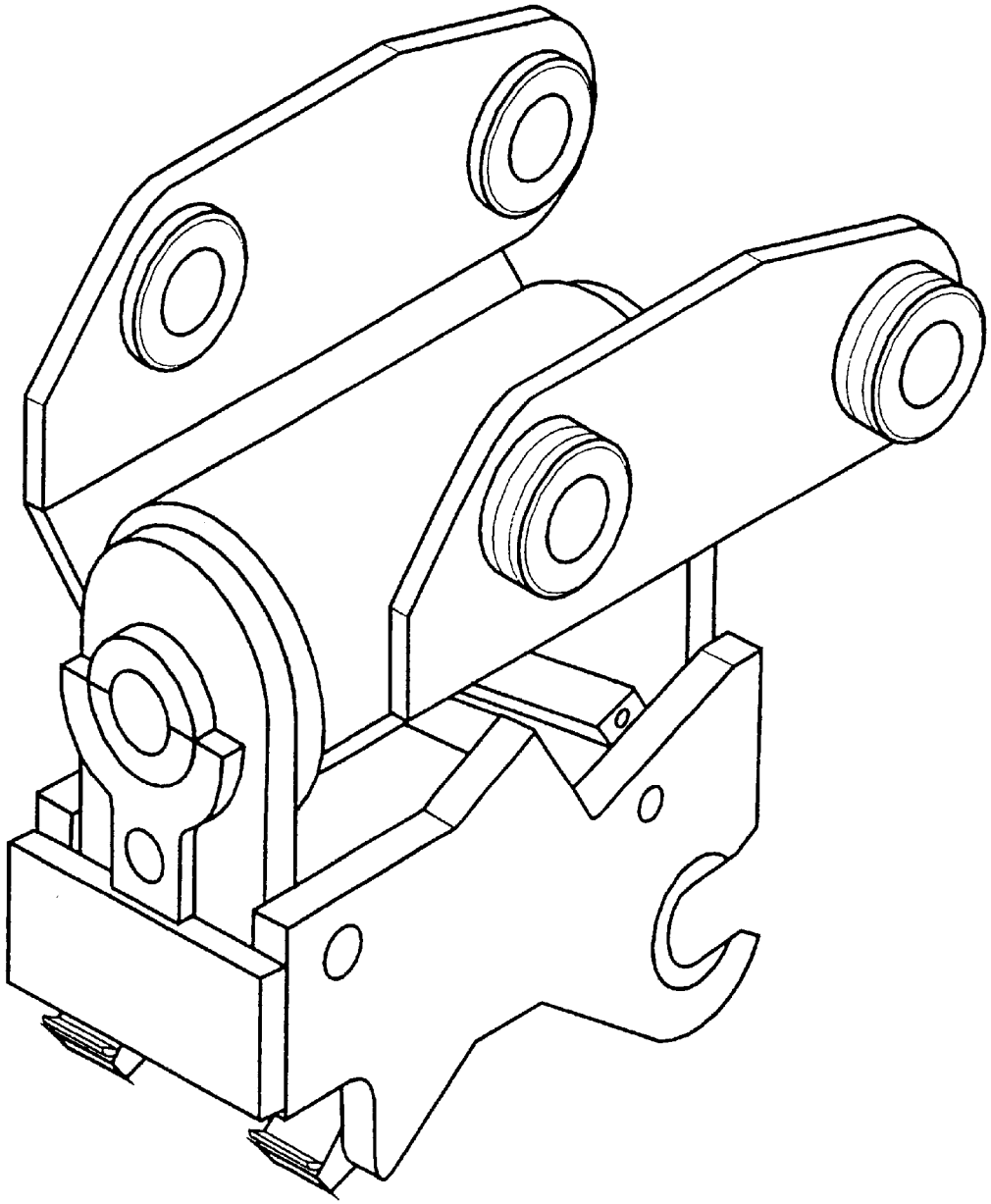
FIG. 6 is a perspective view of the device from the second side slightly to the left of the rotational axis.

The first and second parts are articulated one to the other about an axis X—X. The axis X—X preferably falls in the plane of the arm of the vehicle. With reference to FIG. 4, this plane is generally defined by being substantially normal to the axis B about which the implement carrying section of the arm of the vehicle pivots.

Figure 2:
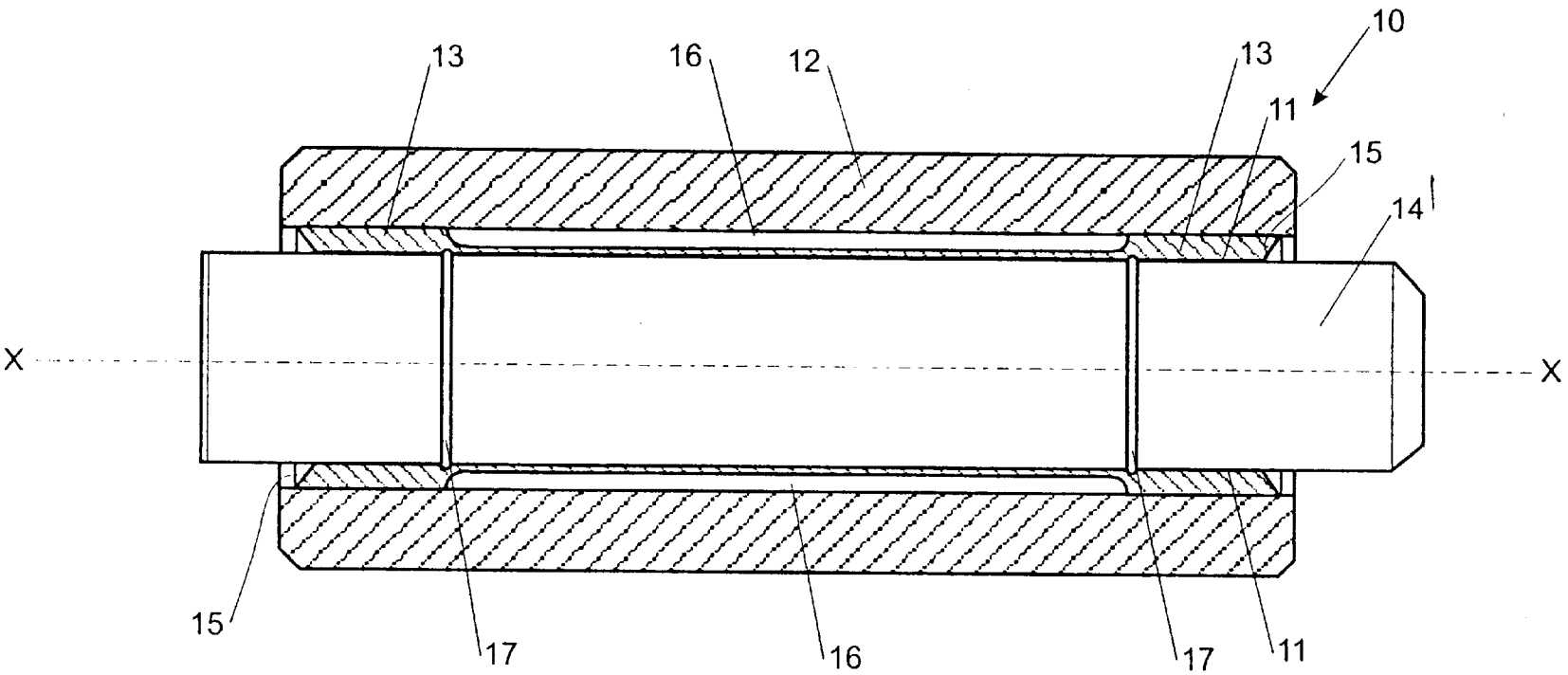
FIG. 2 is a sectional view through Section 2—2 of FIG. 1.
Figure 3B:
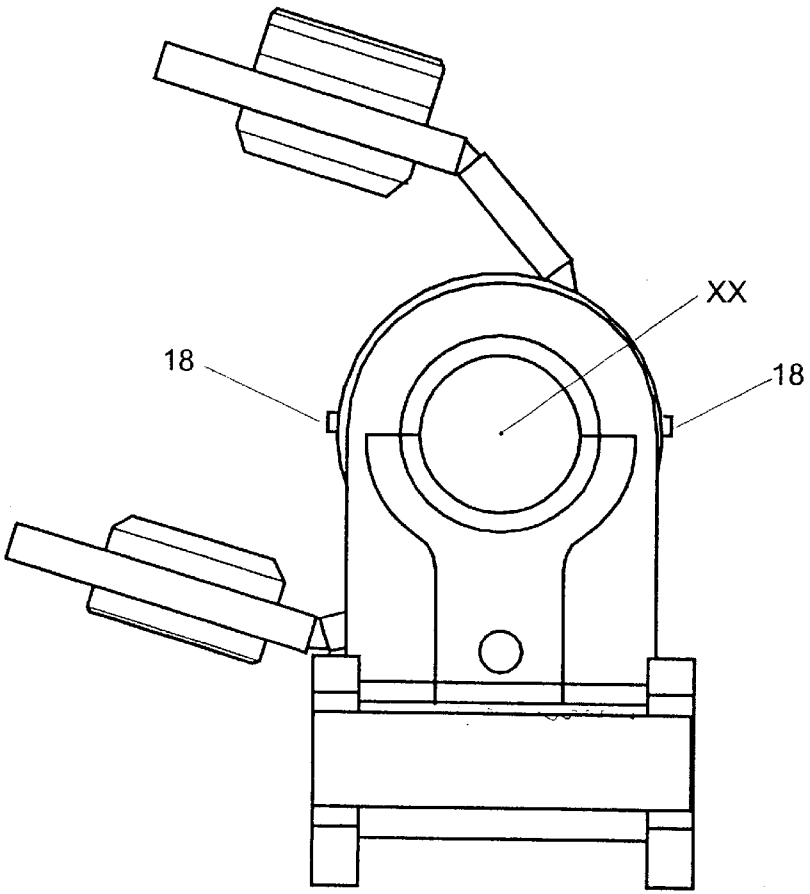
FIG. 3B is an end view of the device 1 as in FIG. 3A but in a different condition.
Figure 3A:
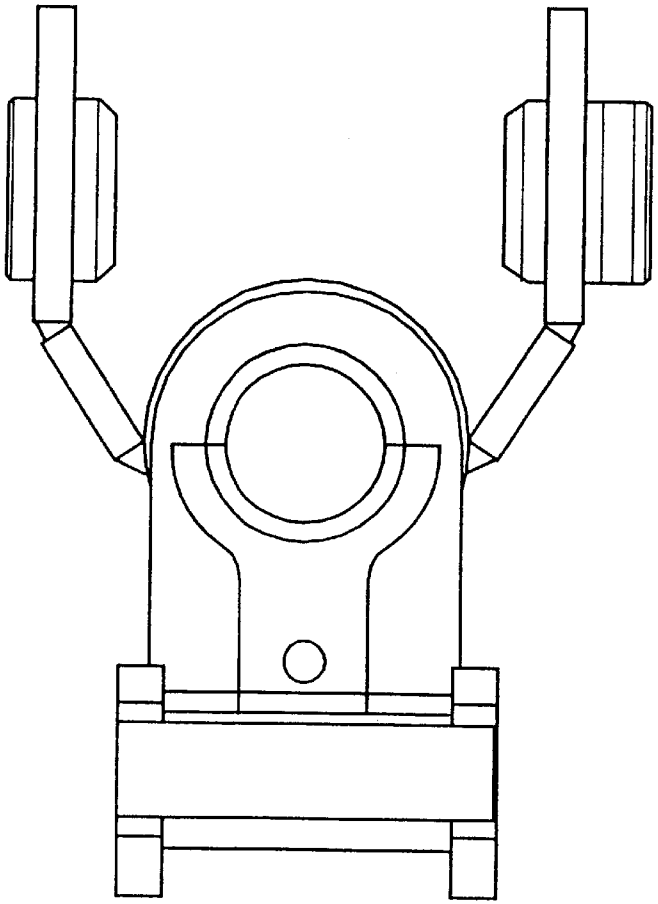
FIG. 3A is a simplified diagrammatic view of the device 1 in one condition.

The articulation of the first and second parts is preferably provided by a shaft and bearing arrangement 10. With reference to FIG. 2, this is preferably provided a shaft 14 which runs in bearings which are preferably provided by part of a sleeve component 13 supported by a housing 12, the members 12 and 13 enclosing a fluid pressureable chamber 16. The bearing of the shaft 14 preferably occurs at bearing regions 11.

Preferably said housing member 12 is made of mild steel.

Preferably said sleeve component 13 is made of medium tensile steel.

Preferably said shaft 14 is made of high tensile hardened and hard chromed steel.

Figure 7:
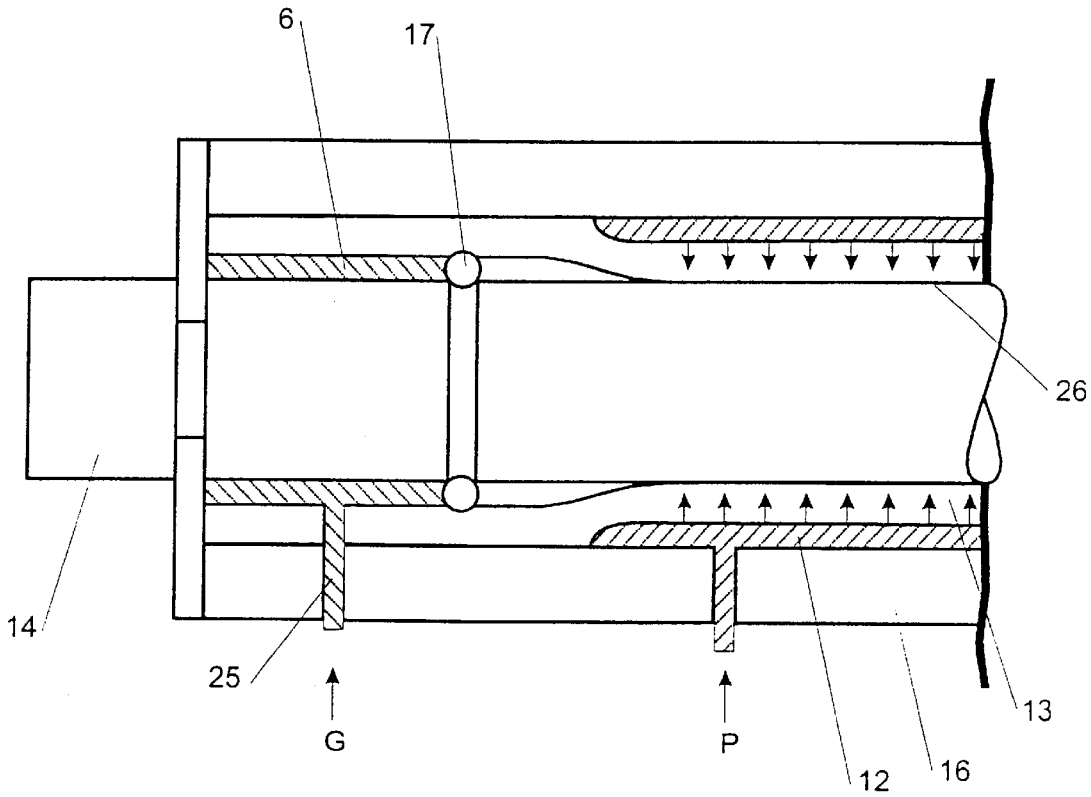
FIG. 7 is a sectional view through one end of the device of the present invention illustrating how the sleeve component may be deformed under the application of a fluid pressure P to increase the frictional interengagement between the shaft 14 and their housing. By the selection of a suitably shaped fluid presurable chamber 16 defined in part by both the sleeve component and part of the housing, deformation of less part of the sleeve component can occur such that when fluid pressure P is applied an increase in frictional interengagement occurs.

At the bearing regions, there is provided between the shaft and the sleeve component, a means to provide lubrication. Such means may be of a suitable lubrication oil and may be delivered to this region via a conduit terminated by a nipple type arrangement. Such a lubricant may be a grease (G) and can be delivered through a conduit 25 as shown in FIG. 7. To avoid any such lubricant G transferring to the region where said frictional interengagement occurs 26, the shaft is preferably provided with a sealing arrangement such as that which can be provided by an O ring 17. Grease pressure applied to the bearing region will be substantially prevented from traveling to the region providing the frictional interengagement by the O rings and will instead encourage such grease to flow out of the housing at the regions where the shaft exits the housing.

The fact that they are spaced apart provides significant strength to the bearing capabilities of the arrangement.

Preferably part of the sleeve component is welded or otherwise secured, to the housing. This securement preferably occurs at the distal ends 15 of said component.

The housing is preferably connected to the first part 2 of the apparatus whilst the shaft is connected to the second part 3. The vice versa may also allow the present invention to operate.

The shaft and bearing arrangement allows for articulation between the first and second parts between two modes. In the first mode the first of second parts are able to articulate relative to each other. As a result of the preferred shaft and bearing arrangement and with the use of suitable lubrication to reduce friction, the shaft can rotate about the axis X—X within the bearing providing means. Such articulation allows for the implement secured to the second part, to be pivoted about the axis X—X.

In the second mode of operation, the first and second parts are prevented from articulating relative to each other. Such operation in the second mode is preferably achieved by a clamping between the shaft and the housing. Such clamping may be achieved by the application or by the release of a pressure to a clamping region between the shaft and housing.

Preferably the clamping region is defined by a section of the sleeve to which a fluid pressure may be applied. This region may for example be a relief or recess in the perimeter of the sleeve. To this, a fluid pressure such as by way of a hydraulic fluid, can be applied to result in a deformation of the sleeve which can result in a clamping force being applied to the shaft.

It must be appreciated that in the preferred form it is an application of force which results in the clamping of the shaft with the housing but in the alternative, it may be the application of a force which releases the clamping force between the shaft and the housing.

What we claim is:

1. An apparatus to connect an implement to a first apparatus, said apparatus comprising a first part adapted for attachment to said first apparatus, a second part adapted for attachment to a second apparatus, said first and second parts being articulated one with respect to the other about an articulation axis, and articulation enabling means actuable between modes whereby, in a first mode, the first and second parts can articulate relative to each other under any applied force as a result of a reduced frictional resistance to articulation between the first and the second parts about an articulation axis, and, upon positive actuation of a second mode, the first and second parts cannot articulate relative to each other under the any applied force as a result of an increased frictional resistance to articulation between the first and second parts about the articulation axis.

2. The apparatus as claimed in claim 1, wherein said means relies upon activation or deactivation of pressurizing of a fluid which can effect, by movement of a component, the frictional resistance to rotation about said axis.

3. The apparatus as claimed in claim 2, wherein said movement is a deformational movement or a relaxation from a previous deformational movement.

4. The apparatus as claimed in claim 1, wherein said first part includes means to receive a pin or pins for attachment to said first apparatus in an axis normal to the articulation axis.

5. The apparatus as claimed in claim 1, wherein said second part is adapted to receive an implement which runs in an axis normal to said articulation axis.

6. The apparatus as claimed in claim 1, wherein said articulation axis is one that is in a lowering and raising plane of an arm.

7. The apparatus as claimed in claim 6, wherein said articulation axis allows movement at least through a rotation arc of said second part relative to said first part but can be prevented from such movement upon a positive actuation at a control of an operator of said means.

8. The apparatus as claimed in claim 1, wherein said frictional resistance is under action of a pressurized fluid.

9. The apparatus as claimed in claim 8, wherein said pressurized fluid is a viscous liquid.

10. The apparatus as claimed in claim 9, wherein said pressurized fluid acts through a fluid inlet and outlet.

11. The apparatus as claimed in claim 10, wherein said fluid inlet and fluid outlet are operated by the control of the operator of said means.

12. The apparatus as claimed in claim 11, wherein said fluid inlet and fluid outlet operate at 55 mpa.

13. The apparatus as claimed in claim 1, wherein said articulation axis is provided by a shaft and bearing arrangement.

14. The apparatus as claimed in claim 13, wherein said shaft and said second part are engaged and said bearing and said first part are engaged.

15. The apparatus as claimed in claim 13, wherein said bearing includes two bearing regions having interposed therebetween a bearing region controllable to allow or not allow the shaft to rotate relative thereof.

16. The apparatus as claimed in claim 15, wherein one of said first and second parts is provided with said bearing and the other is provided with said shaft.

17. The apparatus as claimed in claim 16, wherein said bearing is and said shaft is integral with or fixed to one of the first part and second part so as to not move relative thereto, save to an extent required to allow said bearing to cause control required to allow or not to allow the shaft to rotate relative to the bearing.

18. The apparatus as claimed in claim 15, wherein the bearing includes a fluid jacket about a deformable region which in said second mode prevents rotation of the shaft relative thereto and which in said first mode will allow such rotation.

19. The apparatus as claimed in claim 18, wherein said shaft has a recess at an inside end of said bearing regions.

20. The apparatus as claimed in claim 19, wherein said recess contains an O ring.

21. The apparatus as claimed in claim 20, wherein said O ring prevents axial movement of lubrication grease into said deformable region.

22. Coupling apparatus to connect an implement to a boom assembly of a machine, said coupling apparatus comprising:

a first part adapted to be pivotally attached to the boom assembly at each of two spaced axes of the first part so as to be angularly controllable in a plane normal to a boom axis by a differential movement of the boom; and a second part articulated from said first part on an articulation axis in or parallel to said plane, said second part being adapted for attachment to an implement by capture of part of the implement thereof so that the implement will be positionally controlled by the disposition of said second part, wherein articulation at the articulation axis is controllable by articulation enabling means providing, upon positive actuation, a high friction between proximate surfaces of the first part and the second part locking such articulation and the articulation enabling means providing a reduced friction between proximate surfaces of the first part and the second part allowing such articulation.

* * * * *